US005290979A

United States Patent [19]

Grass

[11] Patent Number: 5,290,979

[45] Date of Patent: Mar. 1, 1994

[54] HANDLE BLOCK FOR ELECTRICAL SWITCHING DEVICE

[75] Inventor: William E. Grass, Milwaukee, Wis.

[73] Assignee: Eaton Corporation, Cleveland, Ohio

[21] Appl. No.: 47,669

[22] Filed: Apr. 19, 1993

[51] Int. Cl.[5] ..... H01H 9/20

[52] U.S. Cl. ..... 200/43.19

[58] Field of Search ..... 200/43.19, 43.16, 43.17, 200/43.18

[56] References Cited

U.S. PATENT DOCUMENTS

| | | | |
|---|---|---|---|
| 2,832,857 | 4/1958 | Landmeier | 200/43.19 |
| 3,109,899 | 11/1963 | Pastene | 200/43.19 |
| 3,629,529 | 12/1971 | Dietz | 200/43.19 |
| 3,678,236 | 7/1972 | Hughes | 200/43.18 |
| 4,158,116 | 6/1979 | Krueger | 200/43.19 |
| 4,300,030 | 11/1981 | Dimarco et al. | 200/43.19 |
| 4,791,525 | 12/1988 | Grass et al. | 361/363 |
| 4,820,887 | 4/1989 | Schmitz | 200/43.18 |
| 4,882,456 | 11/1989 | Hovanic et al. | 200/43.19 X |

FOREIGN PATENT DOCUMENTS

| | | | |
|---|---|---|---|
| 672662 | 7/1979 | U.S.S.R. | 200/43.19 |

*Primary Examiner*—Renee S. Luebke

*Attorney, Agent, or Firm*—L. G. Vande Zande

[57] ABSTRACT

A molded generally planar U-shaped plastic member has a pair of lateral projections on one leg and a single lateral projection at a distal end of the other leg, which projections are received in recesses in mutually facing surfaces of a raised escutcheon rib surrounding a handle opening to locate the base of the U-shaped member in the path of the handle, blocking movement of the handle. A notch in the distal end of the leg having the single lateral projection receives a flat-bladed tool which is twistable against the escutcheon rib surface to deflect the leg inward and projection free of the respective recess to release the handle block. The recesses are symmetrically arranged to permit the handle block to be installed to block the handle ON or OFF as desired.

16 Claims, 1 Drawing Sheet

HANDLE BLOCK FOR ELECTRICAL SWITCHING DEVICE

BACKGROUND OF THE INVENTION

This invention pertains to handle blocks for electrical switching devices having an operating handle for manually moving the switch mechanism between ON and OFF conditions. More particularly, the invention pertains to handle blocks for electrical circuit breakers having pivotally operable handles projecting through an opening in the circuit breaker housing.

In certain applications for circuit breakers it is desirable to provide a blocking member for the handle to prevent the handle from being moved from an ON position to an OFF position or vice versa. The blocking member is not to be a lock for the handle, but merely to be a block; i.e. the blocking member may be intentionally removed to permit movement of the handle and operation of the circuit breaker. In prior art devices, the blocking member relies upon engagement thereof within the handle opening in the case for installation to the case. When the handle opening of the circuit breaker case is made particularly small and close fitting to the operating handle for purposes of sealing the housing against the ingress of foreign material, insufficient space is provided to attach a handle block within the handle opening in the case. One prior art handle block is made of sheet metal formed to a three-dimensional collar overlying the handle wherein it is both costly to manufacture and bulky to store when not in use. Still another prior art handle block comprises a multiple piece assembly which is spring biased into notches in sides of the handle opening, which is also costly to manufacture.

SUMMARY OF THE INVENTION

This invention provides a handle block for an electrical switching device such as a circuit breaker or the like which is a one piece, substantially flat, inexpensive plastic molded part readily storable and easy to install or remove. The handle block of this invention has lateral projections which engage recesses in an escutcheon rib molded integrally with the circuit breaker housing. The rib surrounds the opening for the operating handle, spaced from the opening. A portion of the handle block member is made flexible to enable it to be deflected for purposes of installing or removing the handle block by engaging or disengaging a projection on the handle block with a recess in the escutcheon rib. A tool slot is provided in the flexible portion of the handle block whereby a tool may cooperate with the rib and the flexible portion to effect the deflection of the handle block portion. Pairs of transversely aligned recesses are provided in lateral faces of the escutcheon rib substantially equidistant from a center of the handle opening to enable the handle block to be selectively installed in either of two orientations 180 degrees displaced from each other to block the handle against movement from the ON position or from the OFF position.

DETAILED DESCRIPTION OF THE PREFERRED EMBODIMENTS

Figure 1:
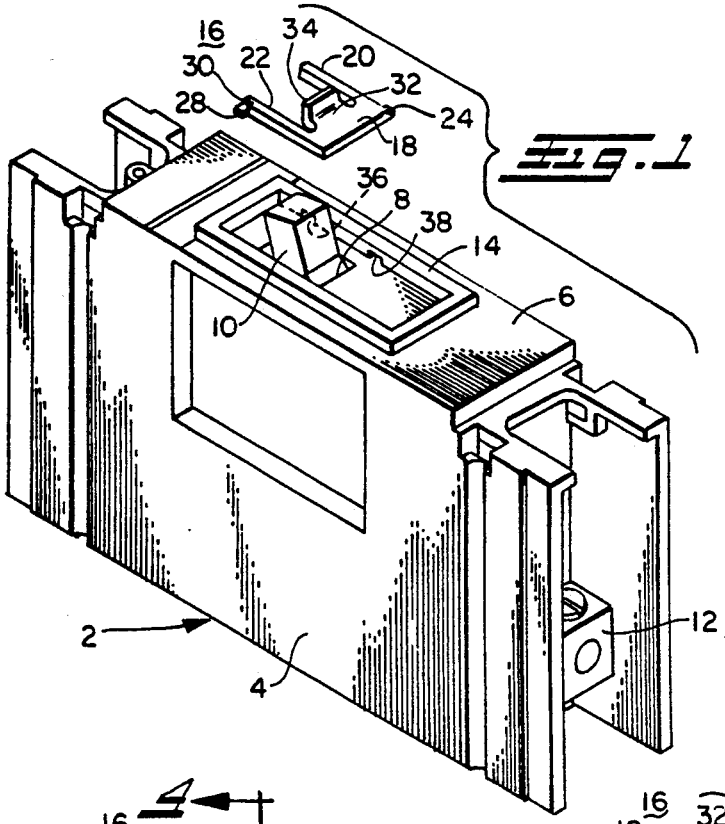
FIG. 1 is an isometric view of a circuit breaker with the handle block of this invention shown spaced therefrom in position to be installed to the circuit breaker in one selected orientation.
Figure 4:
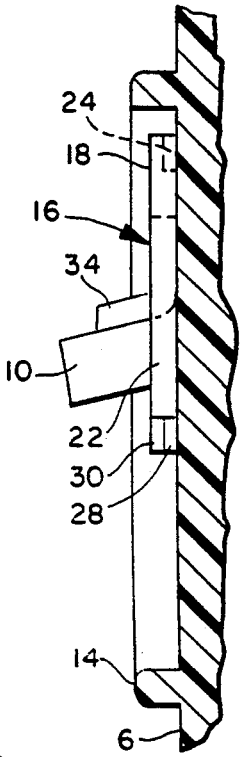
FIG. 4 is a cross sectional view of the escutcheon rib, handle and handle block taken along the line 4—4 in FIG. 3.
Figure 2:
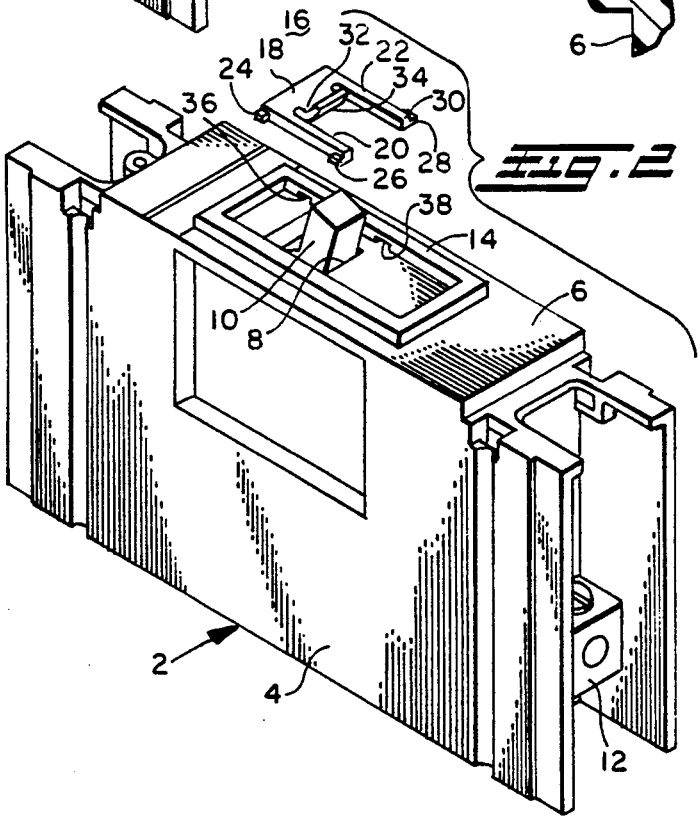
FIG. 2 is a view similar to FIG. 1, but showing the handle block rotated 180 degrees about a vertically extending axis to be installed to the circuit breaker in another selected orientation opposite that depicted in FIG. 1.

FIGS. 1 and 2 of the drawing show a circuit breaker 2 in isometric views. Circuit breaker 2 is a molded case circuit breaker such as the Cutler-Hammer® single pole FS or FH circuit breaker manufactured and sold by the assignee of this invention. The circuit breaker 2 comprises a molded insulating housing 4 having a top wall 6 which contains an opening 8 for a toggle lever operating handle 10 pivotally mounted within the breaker housing. The reference to top wall 6 is for purposes of this description and the orientation in the drawing only inasmuch as wall 6 is a front wall of the circuit breaker in its customary application when mounted in an electrical panelboard or other electrical apparatus. Opening 8 is made to closely conform to the shape of operating handle 10 to provide a good seal between the handle 10 and the housing 4 to prevent the entry of dirt or other foreign particles into the circuit breaker housing as well as to minimize the egress of any arcing or electrical arc gasses when the breaker operates to interrupt an overloaded circuit. Circuit breaker 2 is provided with a pair of wiring terminals 12, one at each end but only one shown, for connecting the circuit breaker to a load and an electrical source. As viewed in the drawings, the left-hand end of the circuit breaker is designated the ON end and the right-hand end is designated the OFF end. When the handle 10 is moved to be closest to the ON end as shown in FIG. 1, the breaker mechanism within the housing 4 is in the ON condition whereby electrical contacts thereof are closed and a circuit is completed through the circuit breaker 2 between the two terminals 12. When the operating handle 10 is moved to be closest to the OFF end of the breaker as shown in FIG. 2, the breaker mechanism is in its OFF condition whereby the electrical contacts are opened and no circuit is completed through the circuit breaker. An escutcheon rib 14 is molded integrally with housing 4 on the top wall 6 thereof to surround the handle 10 and opening 8, spaced from the opening 8. The escutcheon rib 14 may project through an opening in a dead front cover for an electrical panelboard or similar cover for other electrical apparatus in final application of the circuit breaker, thereby exposing only the rib 14, handle 10 and portion of the top wall 6 within the escutcheon rib 14 to the user of the equipment.

The handle block 16 of this invention is a molded plastic U-shaped member having a base 18 with a pair of legs 20 and 22 extending parallel to each other from opposite ends of the base. Leg 20 is provided with a pair of lateral projections 24 and 26 (seen best in FIG. 2), one being located at the base 18 and the other being located at the distal end of leg 20. Leg 22 is provided with a single lateral projection 28 at the distal end of the leg. The distal end of leg 22 is also provided with a tool engaging notch 30 in the upper surface thereof communicating with the lateral surface of the leg 22. Base 18 has a projection 32 which extends parallel to the legs 20 and 22 for a short distance. The distal end of projection 32 extends upwardly in an angular plane substantially parallel to the near or proximal surface of operating handle 10 to abut the handle 10 when the handle block 16 is installed to the circuit breaker 2.

The inwardly or mutually facing surfaces of escutcheon rib 14 at the sides of opening 8 are provided with opposed pairs of laterally aligned recesses 36 and 38. The handle block 16 is installed to the circuit breaker 2 by moving the handle to the desired position, such as the ON position in FIG. 1, orienting the handle block 16 such that the base 18 is disposed on the OFF side of the handle 10 and the legs 20 and 22 extend toward the ON end of the circuit breaker. When so oriented, leg 20 is angled downward to permit projections 24 and 26 to engage in the recesses 38 and 36, respectively, at one side of the opening 8. The handle block 16 is then swung downward such that the leg 22 is brought into proximity of the rib 14 at the opposite side of the opening 8. The spacing between legs 20 and 22 is marginally less than the distance between opposed inner surfaces of raised rib 14 whereby lateral projection 28 on leg 22 prevents the handle block 16 from moving fully into the area within the raised escutcheon rib 14. However, inward pressure on the distal end of leg 22 will defect that leg inwardly sufficient to align the projection 28 with the inner surface of rib 6 to allow the leg 22 to be moved downward against the surface of top wall 6. Lateral projection 28 aligns with the recess 36, and release of leg 22 causes it to flex back to its initial condition whereby the lateral projection 28 engages the recess 36 to hold the handle block 16 firmly in position within the escutcheon rib 14. In this position, distal end 34 of projection 32 rests firmly against the proximal surface of operating handle 10 to prevent it from being moved from the ON position toward the OFF position. The circuit breaker mechanism is a trip-free mechanism and the positioning of handle block 16 in this manner does not prevent the circuit breaker from tripping on the occurrence of an overload. However, it is necessary to remove the handle block 16 to permit the handle 10 to move to its trip indicating position.

Figure 3:
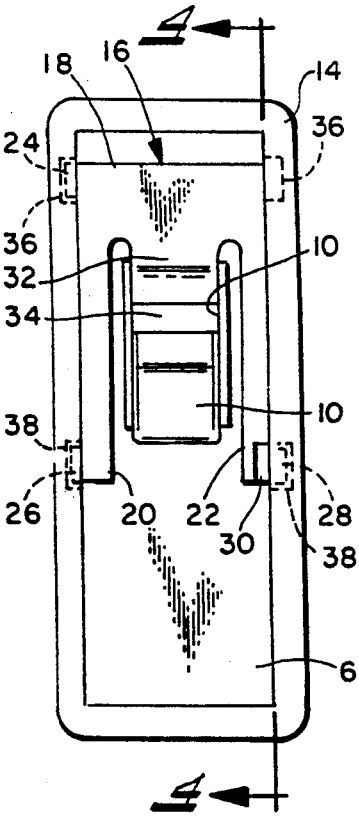
FIG. 3 is a plan view of the escutcheon rib and handle of the circuit breaker of FIGS. 1 and 2 showing the handle block of this invention installed thereto in one of two possible orientations.

As seen in FIG. 3, notch 30 cooperates with the inner lateral face of rib 14 to form a slot that is closed on three sides. Insertion of a flat bladed tool such as a screwdriver into the slot 30 and twisting thereon deflects the leg 22 inwardly to permit the single lateral projection 28 to move free of the appropriate recess 36 or 38 to thereby permit the handle block 16 to be removed. As seen in FIGS. 2 and 3, the handle may be blocked in the OFF position merely by reversing the orientation of the handle block 16 and moving the handle 10 to the OFF position. In this instance, the lateral projections 24 and 26 engage recesses 36 and 38, respectively, in the left-hand inner surface of rib 14 as seen in FIG. 3 and the single lateral projection 28 engages the opposed recess 38 in the right-hand inner surface of the raised rib portion 14.

The molded plastic handle block 16 of this invention is readily and economically made. It's generally planar overall shape renders it easy to store in a workman's tool box, pockets or the like, and therefore very likely available when needed. The handle block 16 is easy to install or remove, yet rigidly maintains its position when an attempt is made to move the handle 10 against the handle block. While the handle block of this invention is shown and described in the best mode contemplated for carrying out this invention, it is to be understood that it is susceptible of various modifications and changes without departing from the scope of the appended claims.

I claim:

1. In combination with an electrical switching device comprising an insulating housing having an opening through a wall thereof, an operating handle extending through said opening reciprocally movable between opposite ends of said opening for operating said switching device between ON and OFF circuit conditions, raised portions on said wall disposed substantially parallel to and spaced from sides of said opening, and transversely aligned recesses in mutually facing surfaces of said raised portions proximate said opposite ends of said opening;

a handle block comprising a U-shaped member having a base and a pair of legs extending from opposite ends of said base substantially parallel to each other and to said mutually facing surfaces of said raised portions, a pair of lateral projections on one of said pair of legs and a single lateral projection on a distal end of the other of said pair of legs, said handle block being removably installed between said raised portions wherein said pair of lateral projections on said one leg are inserted in respective said recesses in said raised portions at one side of said opening, said other leg being resiliently deflectable to permit said single lateral projection to align with one of said recesses in said raised portions at the other side of said opening and to bias said single lateral projection into said one of said recesses to attach said handle block to said housing, and a portion of said base abutting said handle preventing said handle from reciprocally moving within said opening.

2. The combination defined in claim 1 wherein said handle block is removably installable in one of two positions for selectively preventing said handle from reciprocally moving from said ON or said OFF circuit condition.

3. The combination defined in claim 2 wherein said handle block is installable in one of said two positions wherein said base is adjacent one end of said opposite ends of said opening, and is alternatively installable in the other of said two positions wherein said base is adjacent the other of said opposite ends of said opening.

4. The combination defined in claim 3 wherein said base comprises a projection extending therefrom toward said operating handle, said projection abutting a proximal surface of said operating handle.

5. The combination defined in claim 4 wherein a distal portion of said base projection is shaped complementally to said proximal surface in an attitude of said surface with said operating handle in a respective said position to be blocked.

6. The combination defined in claim 5 wherein said U-shaped member is substantially planar and said distal end of said base projection is offset out of the plane of said U-shaped member for extending along said proximal surface.

7. The combination defined in claim 6 wherein said handle is pivotally mounted within said housing and is angularly oriented outside said housing, said proximal surface being angularly disposed and said distal end of said base projection being disposed at an angle complemental thereto.

8. The combination defined in claim 7 wherein said U-shaped member is made of plastic.

9. The combination defined in claim 3 wherein said other leg of said U-shaped member comprises a slot engagable by a tool for deflecting said other leg sufficient to withdraw said single lateral projection free of said one of said recess.

10. The combination defined in claim 9 wherein said slot comprises an open notch in a lateral edge of said other leg, said notch being adjacent a respective one of said raised portions in an installed position of said handle block to define a closed notch, said closed notch receiving a flat-bladed tool therein operable against said raised surface for deflecting said other leg sufficiently to withdraw said single lateral projection free of said one of said recesses.

11. The combination defined in claim 10 wherein said raised portions on said wall comprise a pair of raised ribs integral with said housing.

12. The combination defined in claim 10 wherein said raised portions on said wall comprise a continuous upstanding rib portion integral with said housing and surrounding said opening.

13. A method of blocking movement of an operating handle reciprocally movable between opposite ends of an opening in a wall of an insulating housing of an electrical switching device comprising:

providing raised portions on said wall on opposite sides of said opening parallel to said reciprocal movement of said handle;

providing recesses in mutually facing surfaces of said raised portions in transversely aligned pairs relative to reciprocal movement of said operating handle;

providing a U-shaped handle block member having a transverse base and a pair of legs extending parallel from opposite ends of said base;

providing a pair of lateral projections on one leg of said pair of legs, one projection being at said base and the other projection being at a distal end of said one leg;

providing a single lateral projection at a distal end of the other leg of said pair of legs;

installing said handle block member to said housing by inserting said pair of lateral projections on said one leg into respective said recesses in a said raised portion at one side of said opening;

pivoting said handle block member toward said wall;

deflecting the distal end of said other leg inwardly to permit said single lateral projection thereon to clear said raised portion at an other side of said opening and to align with a respective said recess therein;

permitting said other leg to restore to its original condition and said single lateral projection to enter said respective recess; and providing means on said base abutting a proximal surface of said operating handle preventing movement thereof.

14. The method defined in claim 13 further comprising providing said aligned pairs of recesses in said raised portions substantially equidistant in opposite directions from a midpoint of said opening wherein said handle block member may be installed with said base disposed selectively on either side of said operating handle by rotating said member 180 degrees.

15. The method defined in claim 14 wherein said means provided on said base comprises a projection extending toward said proximal surface, and further comprising providing a distal end of said extension with a surface complemental to said proximal surface.

16. The method defined in claim 15 further providing a tool engaging notch in an upper surface of said other leg, said notch being adjacent and open to a lateral edge of said other leg and disposed adjacent said raised portion in an installed position of said handle block whereby a flat-bladed tool inserted in said notch and twisted against said raised portion deflects said other leg inward.

* * * * *